US006846207B2

(12) United States Patent
Motose et al.

(10) Patent No.: US 6,846,207 B2
(45) Date of Patent: Jan. 25, 2005

(54) RETURN-TO-PORT WARNING DEVICE AND METHOD

(75) Inventors: Hitoshi Motose, Shizuoka (JP); Takashi Okuyama, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/284,512

(22) Filed: Oct. 30, 2002

(65) Prior Publication Data

US 2003/0082963 A1 May 1, 2003

(30) Foreign Application Priority Data

Oct. 30, 2001 (JP) ..... 2001-333207

(51) Int. Cl.[7] ..... B63H 23/00
(52) U.S. Cl. ..... 440/1; 440/2; 701/21
(58) Field of Search ..... 440/1, 2; 701/21

(56) References Cited

U.S. PATENT DOCUMENTS

| | | | | |
|---|---|---|---|---|
| 4,708,669 | A | | 11/1987 | Kanno et al. |
| 4,796,206 | A | | 1/1989 | Boscove et al. |
| 4,822,307 | A | | 4/1989 | Kanno |
| 5,136,279 | A | | 8/1992 | Kanno |
| 5,209,682 | A | | 5/1993 | Duning et al. |
| 5,325,082 | A | | 6/1994 | Rodriguez |
| 5,481,261 | A | | 1/1996 | Kanno |
| 5,633,573 | A | | 5/1997 | van Phuoc et al. |
| 5,687,694 | A | | 11/1997 | Kanno |
| 6,015,317 | A | * | 1/2000 | Hoshiba et al. ..... 440/1 |
| 6,109,986 | A | * | 8/2000 | Gaynor et al. ..... 440/87 |
| 6,154,703 | A | | 11/2000 | Nakai et al. |
| 6,157,297 | A | | 12/2000 | Nakai |
| 6,157,890 | A | | 12/2000 | Nakai et al. |
| 6,377,879 | B2 | | 4/2002 | Kanno |
| 6,401,028 | B1 | | 6/2002 | Kamiya et al. |
| 2003/0074114 | A1 | * | 4/2003 | Okuyama et al. ..... 701/21 |

OTHER PUBLICATIONS

International Standard ISO 11783–5, First Edition May 1, 2001, Tractors and machinery for agriculture and forestry—Serial control and communications data network.

NMEA 2000; Standard for Serial Data Networking of Marine Electronic Devices; Main Document; Version 1.000, Sep. 12, 2001; @NMEA 1999, 2000, 2001.

NMEA 2000; Standard for Serial Data Networking of Marine Electronic Devices; Appendix A; Version 1.000, Sep. 12, 2001; @NMEA 1999, 2000, 2001.

NMEA 2000; Standard for Serial Data Networking of Marine Electronic Devices; Appendix B; @NMEWA 1999, 2000, 2001.

NMEA 2000; Standard for Serial Data Networking of Marine Electronic Devices; Appendix C; Version 1.000, Sep. 12, 2001, @NMEA 1999, 2000, 2001.

(List continued on next page.)

*Primary Examiner*—Sherman Basinger
(74) *Attorney, Agent, or Firm*—Knobbe, Martens, Olson & Bear, LLP

(57) ABSTRACT

A watercraft is equipped with an outboard motor and an inboard local area network (LAN) that communicates control signals to the outboard motor. An outboard motor operating device retains the ability to operate the outboard motor even if part of the inboard LAN develops an abnormality. In particular, a control signal that controls the outboard motor and a conditional information signal that indicates a condition of the watercraft are transmitted by independent cables that are mutually separated. Even if the cable for transmitting the conditional information signal or equipment connected to the cable develops an abnormality, transmission of the control signal for controlling the outboard motor is not hindered since the control signal is on the other cable, which is not affected by the abnormality. The conditional information signals are processed to generate and display return-to-port warnings based on the watercraft conditions and other operator issued constraints.

22 Claims, 3 Drawing Sheets

OTHER PUBLICATIONS

NMEA 2000; Standard for Serial Data Networking of Marine Electronic Devices; Appendix D; Version 1.000, Sep. 12, 2001, @NMEA 1999, 2000, 2001.

NMEA 2000; Standard for Serial Data Networking of Marine Electronic Devices; Appendix E; ISO 11783–5 Network Management.

NMEA 2000; Standard for Serial Data Networking of Marine Electronic Devices; Appendix F; ISO 11783–3 DataLink Layer.

International Standard, ISO 11783–5, First edition May 1, 2001, Tractors and machinery for agriculture and forestry–Serial control and communications data network, Part 5: Network management.

* cited by examiner

RETURN-TO-PORT WARNING DEVICE AND METHOD

PRIORITY INFORMATION

This application is based on and claims priority under 35 U.S.C. § 119 to Japanese Patent Application No. 2001-333207 filed on Oct. 30, 2001, the entire contents of which are hereby expressly incorporated by reference herein.

BACKGROUND OF THE INVENTION

1. Field of the Invention

The present invention is directed to a watercraft, and more specifically, to a watercraft comprising an engine control unit capable of producing a return-to port warning signal.

2. Description of the Related Art

Watercraft such as pleasure boats, fishing boats, or the like, use motors (e.g., outboard motors mounted on transoms) to provide power to propellers or other thrust generating devices for moving the watercraft forward and backward. For example, an outboard motor typically incorporates an internal combustion engine mounted at the top and external to the watercraft structure. The motor is coupled to a propeller or other thrust generating device, which is submerged in water and is used to propel the watercraft. A typical outboard motor includes various linkages between the hull and the motor that allow an operator control the operation of the outboard motor. These linkages take various forms such as mechanical cables, hydraulic lines, electrical wires, or fiber optical cables.

For example, the outboard motor may include an air induction system to provide air to the combustion chambers of the motor. Frequently, the air induction system has a throttle valve to regulate the quantity of air delivered to the engine's combustion chambers in response to the operator. Alternatively, engine may include a speed regulating device to control the speed of the engine by controlling the amount of fuel delivered to the combustion chambers or by controlling the ignition timing. In either configuration, input from the operator is coupled to the appropriate regulating mechanism of the motor located at the rear of and externally to the hull of the watercraft. A controller comprising a lever may be used that is pivotally or slidably mounted to the body of the controller. As the operator moves the lever the appropriate regulating mechanism controls operation of the motor. Other components in the motor section of the watercraft controlled by the operator require additional linkages between the hull and motor. Such components include throttle actuators, shift actuators, steering actuators, and trim control devices.

A watercraft may include a local area network (LAN) to simplify the system of linkages between the hull and the motor. The LAN may advantageously be coupled to sensors and other electronic devices that monitor the states of the motor or other components the watercraft. The LAN also communicates control signals from an operator to the motor.

SUMMARY OF THE INVENTION

One potential problem with a local area network (LAN) that interconnects components in a watercraft is that excessive noise in a component connected to the network, the failure of such a component, or the failure of network wiring can affect, sometimes catastrophically, a critical part of the network, such as the components and devices used to directly control the operation of an outboard motor. For example, it is undesirable that the operation and control of the outboard motor becomes difficult or impossible because of an abnormality in the communication lines connected to a fuel level detector or to a Global Positioning System (GPS) receiver and processor (hereinafter GPS). Thus, a system for a watercraft or an outboard motor or a combination of a watercraft and an outboard motor with an inboard LAN is needed wherein the outboard motor is controlled by a control device via a separate portion of the LAN that is capable of retaining the operation capabilities of the outboard motor even if another portion of the inboard LAN develops an abnormality.

One aspect of an embodiment in accordance with the present invention is a control system for an outboard motor that comprises a control input section, a control section, and a conditional information section. The control input section receives at least one command to control an outboard motor. The control section controls the outboard motor in response to the command received by the control input section. The conditional information section outputs at least one conditional information signal indicative of a condition of a watercraft. The outboard motor further comprises a first cable is connected to the control input section and a second cable connected to the conditional information section, where the second cable separate from the first cable.

The control input section produces a control signal via the first cable that is used to control the outboard motor. Thus, the conditional information signal is differentiated from the control signal that controls and operation of the outboard motor. Therefore, even if the second cable for transmitting the conditional information signal or equipment connected to the second cable develops an abnormality, the transmission of the control signal in the first cable for controlling the outboard motor is not hindered.

The control signal outputted by the control input section may include a signal that is used by the controls the performance of one or more of a throttling operation, a shifting operation, a steering operation of the outboard motor, starting the engine or stopping the engine. For example, the control signals are advantageously used to control a throttle actuator for operating a throttle connected to the outboard motor, or the like.

The outboard motor may also advantageously include an indication device such as a display device (e.g., video monitor) that receives a signal that indicates the conditional information of the watercraft. The displayed information may represent raw data as sent by, for example, a sensor, or the displayed information may represent processed data derived from calculations based, at least in part, on such raw data. The signal received by the indication device is used to indicate at least one condition of the watercraft to a driver, but this signal is not use to control the outboard motor.

The first and second cables may be different from each other in colors, shapes, or diameters. By using different colors, shapes, and diameters of the cables, the cables transmitting the control signal and the cables transmitting the conditional information signal are easier to discriminate, thus reducing or preventing misconnection of the cables. For example, if the cables for each type of signal includes multiple interconnected cables, the cables corresponding to each type of signal advantageously have corresponding colors or diameters (for example, the same color or diameter) so that only the cables communicating the same types of signals are interconnected.

In particularly preferred embodiments, the cables have connectors, and the connectors for the cable for the control signals are different from the connectors for the cables for the conditional information signals. The different connectors prevent incorrect coupling of a cable for the control signals with a cable for the conditional information signals.

Another aspect in accordance with embodiments of the present invention is an outboard motor operating device. The outboard operating device comprises an indication section and a control input section. The indication section indicates a condition of a watercraft, while the control input section receives at least one command to control the watercraft and outputs at least one control signal corresponding to the command. The outboard operating device further comprises a first cable that transmits the control signal outputted from the control input section and a second cable that transmits a condition signal indicative of the condition of the watercraft to the indication section, where the second cable separate from the first cable.

The control signal and the condition signal are transmitted by separate cables. Therefore, even if the cable for transmitting the condition signal or equipment connected to the cable develops an abnormality, the transmission of the control signal for controlling the outboard motor is not hindered.

In accordance with another aspect of embodiments of present invention, a watercraft comprises an indication section and a control input section. The indication section indicates a condition of a watercraft, while the control input section receives at least one command to control an outboard motor and outputs a control signal corresponding to the command. The watercraft further comprises a first cable that transmits the control signal outputted from the control input section and a second cable that transmits a condition signal indicative of the condition of the watercraft to the indication section, wherein the second cable is separate from the first cable. The watercraft further comprises a third cable corresponding to the first cable that transmits the control signal and a fourth cable corresponding to the second cable that transmits the condition signal, wherein the fourth cable is separate from the third cable. The watercraft further comprises a control section that controls the outboard motor based on the control signal transmitted by the third cable and a conditional information section coupled to the control section via at least one of the second cable and the fourth cable.

Cables for transmitting a control signal between the outboard motor and the hull are provided separately for the control signal and the conditional information signals, so that even if a cable for transmitting the condition signal develops an abnormality or even if equipment connected to the cable develops an abnormality, transmission of the control signal for controlling the outboard motor on the separate cable is not hindered.

During operation of a watercraft, a course is plotted that typically involves meeting certain fuel constraints, time constraints or a combination of fuel constraints and time constraints. Meeting such constraints involves monitoring the distance to a destination, the amount of fuel remaining in the fuel tank, and the current time. A Global Positioning System (GPS) may be used to enable the operator to determine the distance to the destination by providing the current coordinates of the watercraft and by comparing these coordinates to known destination coordinates. This information, combined with a measure of the fuel remaining in the fuel tank, allows the operator to determine, for example, the distance of watercraft from the destination, whether the watercraft has sufficient fuel to reach the destination, and the amount of time required to arrive at the destination at an expected watercraft velocity. However, an operator typically is more concerned with the other aspects of a watercraft activity, such as fishing, water-skiing, or the like. Thus, a need exists for an automated system for informing an operator that a potential problem exists with respect to an available quantity of fuel or an available amount time to return to a home port. As discussed below, one aspect of embodiments in accordance with the present invention is a system that automates the calculation of the trip constraints, such as the constraints discussed above, and that warns an operator when a potential problem exists.

Another aspect in accordance with embodiments of the present invention is a return-to-port warning device. The return-to-port warning device comprises a maximum cruising distance calculation section that calculates a maximum cruising distance based on a residual amount of fuel and a fuel consumption ratio. A return-to-port distance calculation section calculates a return-to-port distance from the current location to a home port. A return-to-port judgment section judges whether a return-to-port warning is issued to encourage the operator of the watercraft to return to the home port. The return-to-port judgment section bases a judgment on a comparison between the maximum cruising distance calculated by the maximum cruising distance calculation section and the return-to-port distance calculated by the return-to-port distance calculation section. The maximum cruising distance calculated from the residual amount of fuel is compared with a distance to the home port, and a return-to-port warning is issued when the maximum cruising distance approaches the distance to the home port. By providing the return-to-port warning, situations are prevented in which a watercraft operator fails to notice that the residual fuel has become too low or that the watercraft is too far away from the home port such that returning to the home port becomes difficult or impossible because of insufficient fuel.

In embodiments in accordance with this aspect, the return-to-port warning device comprises an expected return-to-port time storage section that stores an expected return-to-port time (e.g., a time by which the operator planned to return to the home port or other port of the watercraft). An arrival time calculation section calculates an estimated arrival time at the home port based on the return-to-port distance calculated by the return-to-port distance calculation section and a watercraft velocity. A second return-to-port judgment section judges whether a second return-to-port warning is issued to encourage the operator of the watercraft to return to the home port. The second judgment section judges whether to issue the second return-to-port warning based on a comparison between the arrival time calculated by the arrival time calculation section and the expected return-to-port time stored in the expected return-to-port time storage section. This aspect of the preferred embodiments prevents a situation in which time has elapsed without being noticed by the watercraft operator or a situation in which the watercraft has cruised too far away from the home port such that that an insufficient time remains for the watercraft to return to the home port by the expected return-to-port time.

BRIEF DESCRIPTION OF THE DRAWINGS

Preferred embodiments in accordance with aspects of the present invention will be described below in connection with the accompanying drawing figures in which.

DETAILED DESCRIPTION OF THE PREFERRED EMBODIMENT

Figure 1:
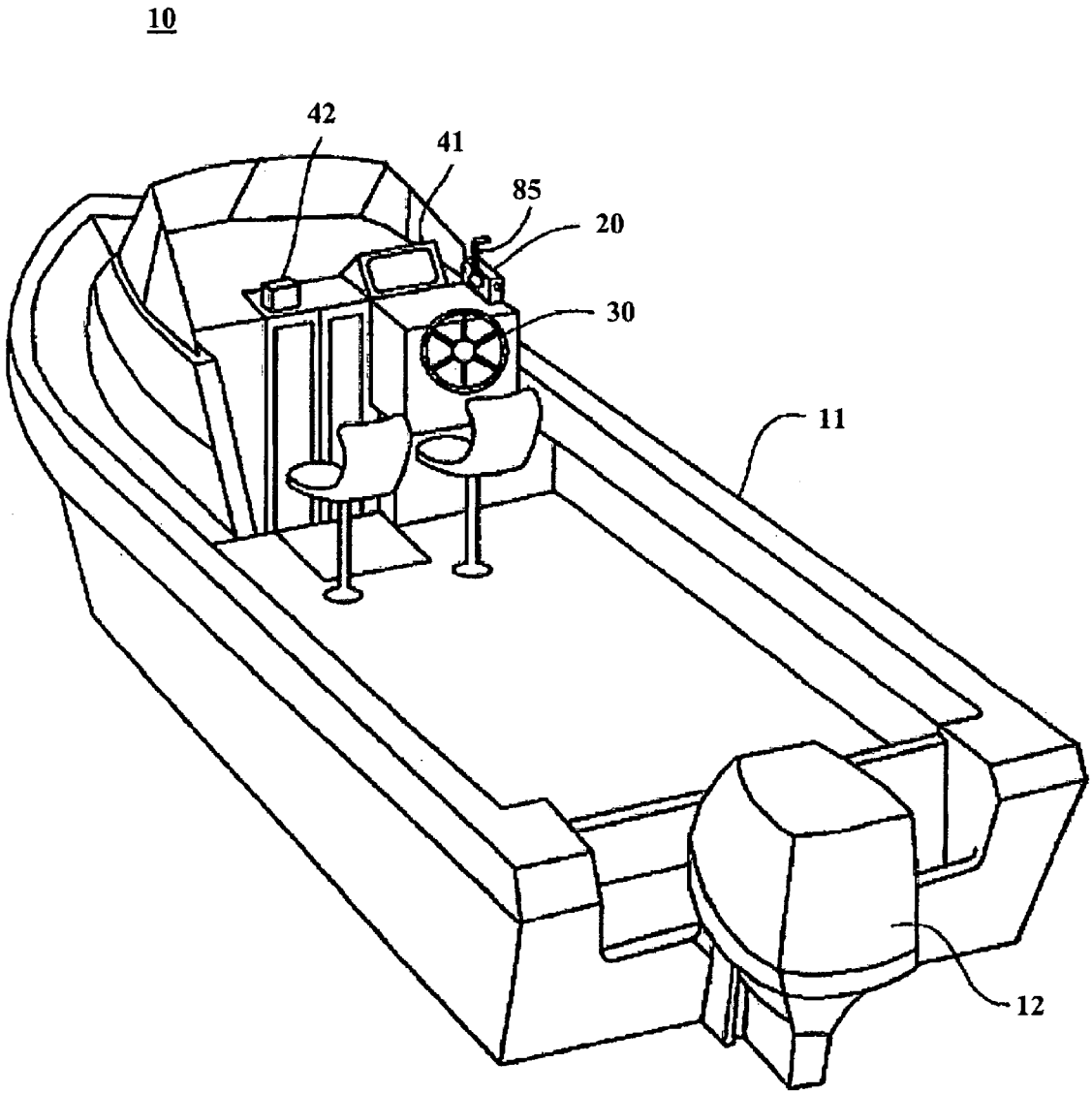
FIG. 1 is a perspective view showing a watercraft according to an embodiment of the present invention;.
Figure 2:
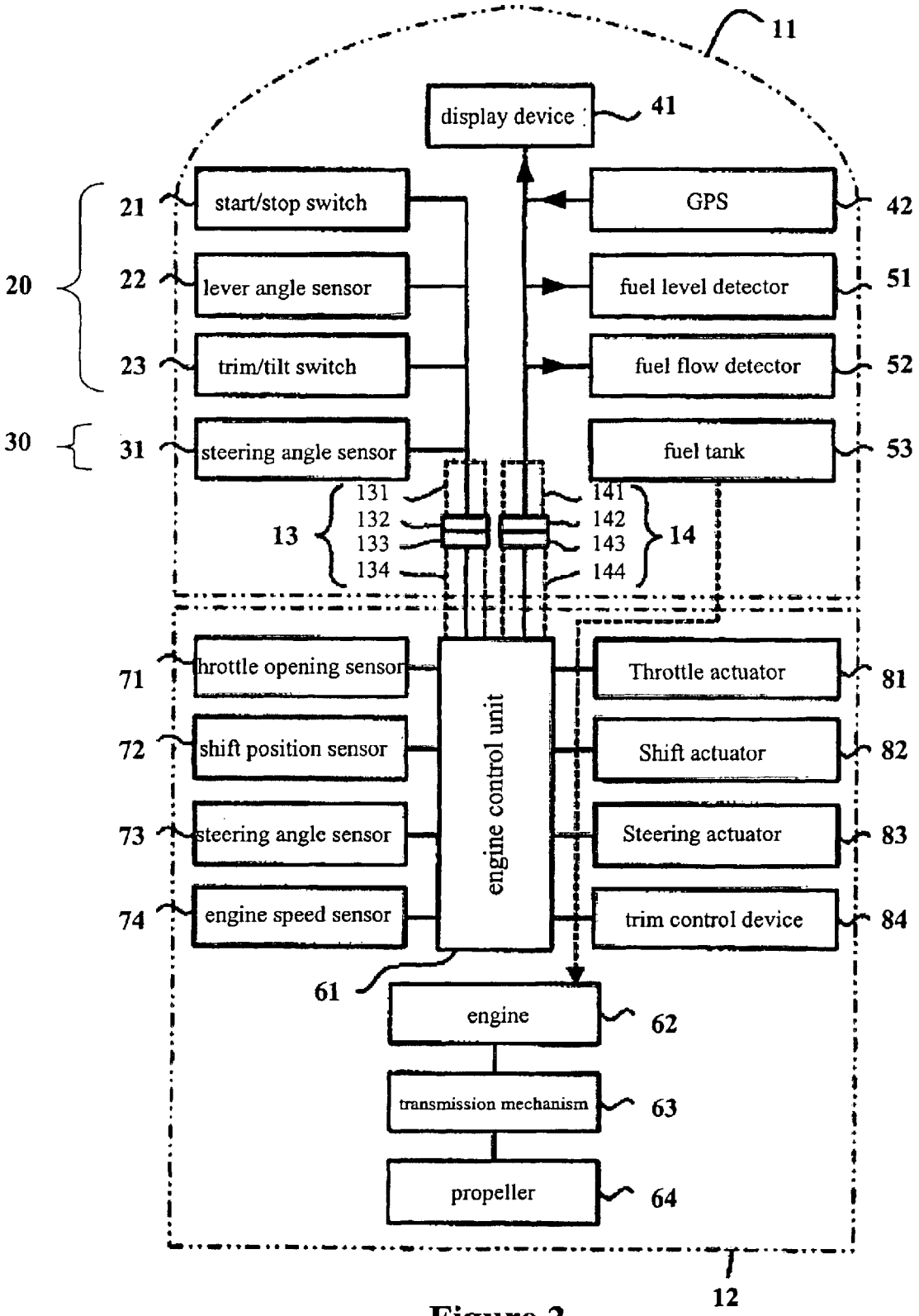
FIG. 2 is a block diagram showing the general construction of a watercraft according to an embodiment of this invention.
Figure 3:
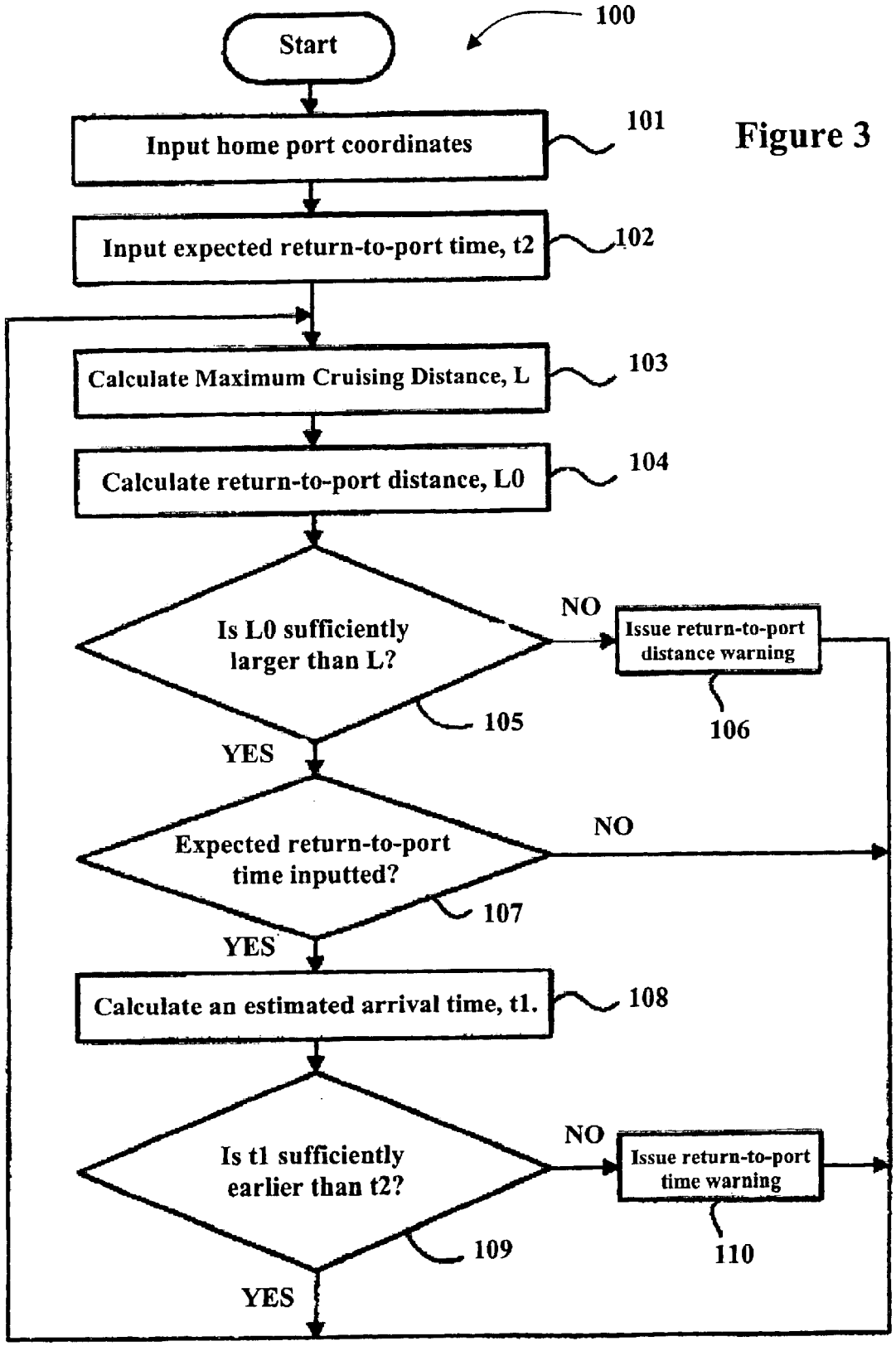
FIG. 3 is a flowchart showing a procedure for a return-to-port consistent with embodiments of the present invention.

FIGS. 1–3 illustrate the overall construction and operation of a watercraft 10 that employs a LAN in accordance with certain features, aspects, and advantages of the present invention. The use of a LAN in conjunction with an outboard motor, as shown in FIGS. 1–3, is illustrative of a typical application of the present invention and should not be construed as limiting. For instance, certain features, aspects, and advantages of the present invention find application in a wide variety of watercraft.

FIG. 1 illustrates a perspective view of the watercraft 10 in accordance with a preferred embodiment of the present invention. As shown in FIG. 2, the watercraft 10 comprises a hull 11 and an outboard motor 12 mounted to the hull 11. The watercraft 10 further includes a first connecting line 13 and a second connecting line 14 that interconnect electronic circuits on the hull 11 and electronic circuits on the outboard motor 12. In certain embodiments, the hull 11 comprises a control unit 20 that enables an operator to control the operations of the outboard motor 12 from a pilot or operator's seat in a cockpit area of the hull. For example, as shown in FIG. 2, the control unit 20 includes a start/stop switch 21, a lever angle sensor 22 and a trim/tilt switch 23. The control unit 20 further includes a steering device 30 connected to a steering sensor 31. The hull 11 further comprises an inboard indication device 41; a Global Positioning System (GPS) 42; a fuel level detector 51; a fuel flow detector 52; and a fuel tank 53.

In particular embodiments, the outboard motor 12 comprises an engine control unit (ECU) 61, an engine 62, a transmission 63, and a thrust generator (e.g., a propeller) 64. The ECU 61 is connected to a plurality of sensors such as, for example, a throttle opening sensor 71, a shift position sensor 72, an motor angle sensor 73, and an engine speed sensor (e.g., a tachometer) 74. The ECU 61 is also connected to a plurality of actuators such as, for example, a throttle actuator 81, a shift actuator 82, a steering actuator 83, and a trim control device 84.

The ECU 61 controls the general operations of the outboard motor 12 and advantageously comprises a central processing unit (CPU), one or more storage devices (e.g., RAM, ROM, EPROM, etc.), one or more auxiliary storage devices (e.g., non-volatile RAM, hard disc, CD-ROM, optical or magnetic disc, etc.), and a clock.

The connecting line 13 comprises a cable 131 that originates in the hull 11 and a cable 134 that originates in the outboard motor 12. A connector 132 is coupled to a free end of the cable 131, and a connector 133 is coupled to a free end of the cable 134. The connector 132 is normally connected to the connector 133 to thereby interconnect the cable 131 and the cable 134 as the connecting line 13.

The connecting line 14 comprises a cable 141 that originates in the hull 11 and a cable 144 that originates in the outboard motor 12. A connector 142 is coupled to a free end of the cable 141, and a connector 143 is coupled to a free end of the cable 144. The connector 142 is normally connected to the connector 143 to thereby interconnect the cable 141 and the cable 144 as the connecting line 14.

The start/stop switch 21 is a switching device that produces a start/stop signal that the operator activates in a first manner to start the engine 62 and that the operator activates in a second manner to stop the engine 62. For example, in particular embodiments, the start/stop switch 21 produces a first logic signal to start the engine 62 and produces a second logic signal to stop the engine 62. Alternatively, the start/stop switch 21 may comprise two switching elements, with one switching element generating a start signal and the other switching element producing a stop signal.

In particular embodiments, the lever angle sensor 22 detects the inclination (angle) of a remote control lever 85 of the remote control 20. The ECU 61 uses the lever angle signal from the lever angle sensor 22 to adjust the throttle actuator 81 and to adjust the shift actuator 82. For example, the ECU 61 is advantageously programmed such that when the remote control lever 85 is in a neutral position, no power is communicated to the propeller 64, and the propeller 64 does not rotate. Thus, no thrust is applied to the watercraft 10 when the remote control lever 85 is in the neutral position.

The ECU 61 is advantageously further programmed such that when the remote control lever 85 is inclined toward the bow from the neutral position, power is communicated to the propeller 64 via the transmission 63 to cause the propeller 64 to rotate in a first rotational direction to cause the watercraft 10 move in a forward direction (e.g., in the general direction in which the bow of the hull is pointing). Conversely, when the remote control lever 85 is inclined toward the stem from the neutral position, power is communicated to the propeller 64 via the transmission 63 to cause the propeller 64 to rotate in a second rotational direction opposite the first rotational direction to cause the watercraft 10 to move in a backward direction opposite the forward direction.

The ECU 61 is advantageously further programmed such that when the remote control lever 85 is inclined toward the bow or the stem by more than a threshold angle, the throttle of the engine 62 is operated gradually to increase the rotational speed of the propeller 64 to increase the watercraft velocity. Other embodiments of the remote control lever 85 and lever angle sensor 22 are consistent with the present invention. For instance, remote control lever 85 may comprise separate levers for the shift control function and the throttle control function. The remote control lever 85 may also take the form of a computer input device such as a key board, mouse, or similar device. In such embodiments, the remote control lever 85 interfaces directly with the ECU 61 without needing the lever angle sensor 22. In other embodiments, the remote control lever 85 interfaces with a separate, microprocessor-driven device that communicates with the ECU 61 via the connecting line 13.

The trim/tilt switch 23 preferably comprises a switching device that produces a trim/tilt control signal to control the trim control device 84. The trim control device 84 is controls an actuator (not shown) that adjusts the tilt and trim of the outboard motor 12. As described in greater detail below, the pitch (e.g., the up or down position) of the bow 11 of the watercraft 10 during operation is controlled in response to the operator setting the trim/tilt switch 23 upwardly and downwardly. Controlling the pitch of the bow enables the operator to select a condition that effects a balance between efficiency (in terms of rate of fuel consumption) and stability of watercraft during maneuvering.

The steering device 30 preferably comprises a steering wheel, and the steering sensor 31 detects the angular orientation of the steering device 30 with respect to a neutral position of the steering device 30. The steering sensor 31 outputs a steering angle control signal to the ECU 61. The ECU 61 is responsive to the steering angle control signal to control the steering actuator 83 in the outboard motor 12. When the operator turns the steering device 30, the steering actuator 83 changes the angular orientation in a horizontal plane of the outboard motor 12 relative to the hull 11, which changes the direction in which the thrust generated by the propeller 64 is applied with respect to the hull 11. Thus, the direction of motion of the watercraft 10 through the water is controlled in response to the steering commands of the operator applied to the steering device 30.

The indication device 41 preferably comprises a display device such as, for example, a CRT (cathode-ray tube) or an LCD (liquid crystal display). The indication device 41 provides the operator with a plurality of types of information described below. For example, the types of displayed information may include information representing the state (e.g., operating conditions) of the watercraft 10.

The GPS 42 advantageously determines the current location of the watercraft 10 based on a signals transmitted from a plurality of satellites. In particular, the GPS 42 processes the signals received from the satellites to calculate the current coordinates of the watercraft 10. The GPS 42 outputs the coordinate information in an appropriate format to the ECU 61 via the cable 31.

The fuel level detector 51 detects the amount of fuel remaining in the fuel tank 53, which amount decreases as the fuel tank 53 supplies fuel to the engine 62. The fuel level detector 51 outputs a signal representing the amount of fuel remaining in the fuel tank 53 to the ECU 61 via the cable 31 in an appropriate format.

The fuel flow detector 52 detects the rate of flow rate of fuel from the fuel tank 53 to the engine 62 in units of volume per unit time (e.g., gallons per hour or liters per minute). The fuel flow information is advantageously combined with the fuel level information from the fuel level detector 51 to enable the ECU 61 to calculate a maximum cruising time. In particular embodiments, the velocity of the watercraft 61 is also known, and the velocity information is combined with the maximum cruising time to calculate a maximum cruising distance.

In certain embodiments, the ECU 61 functions as a control section that controls the watercraft 10 in response to one or more commands received by a control input section. The control input section receives operational information (e.g., manual inputs applied by the watercraft operator) that is used to operate an outboard motor 12 and outputs at least one control signal in response to the operational information. Preferably, the control input section comprises the steering sensor 31 and the various devices of the control unit 20 (e.g., the start/stop switch 21, the lever angle sensor 22, and the trim/tilt switch 23); however, as will be appreciated by one skilled in the art, the control input section may additionally comprise other devices. For instance, the remote control lever 85 may have separate levers for the shift control function and the throttle control function. In such a case, the control input section would comprise an additional lever angle sensor similar to the lever angle sensor 22.

In certain embodiments, the control section (i.e., the ECU 61) also receives information indicative of the condition of the watercraft 10 from a conditional information section that outputs at least one conditional information signal. Preferably, the conditional information section comprises the GPS 42, the fuel level detector 51, and fuel flow detector 52, although other combinations of more or fewer components are also consistent with embodiments of the present invention. The output from conditional information section is indicative of the condition of the watercraft 10. In certain embodiments, the control section sends a condition signal to an indication section, such as the screen of the indication device 41, based on the information contained in the conditional information signal. Preferably, as discussed in more detail below herein, the ECU 61 uses information from the conditional information section to make further calculations regarding the state of the watercraft 10 that are also displayed on the indication device 41 or other output device.

As discussed above, the engine 62 is coupled to the propeller 64 via the transmission 63 to provide the propulsion force that moves the watercraft 10 through the water. The engine 62 is started from a stopping condition or stopped from an operating condition, based on a start/stop signal from the start/stop switch 21. Preferably, the engine has a throttle (not shown) for controlling the amount of fuel and air supplied to the combustion chamber and thereby controlling engine speed. Other devices for controlling engine speed may also be used.

The transmission 63 comprises a shifter (not shown) that adjusts the torque range produced at the propeller 64 by the engine 62. The shifter also enables the propeller 64 to be in a neutral condition of no rotation, a condition of normal rotation and a condition of reverse rotation. The neutral condition may be used when idling and as an intermediate condition between the condition of normal rotation and the condition of reverse rotation. Thus, the power applied to the propeller 64 is advantageously removed before changing the direction of rotation of the propeller 64.

The throttle opening sensor 71 detects a degree of opening of the throttle of the engine 62 and outputs this information to the ECU 61. The shift position sensor 72 detects the position (e.g., neutral, advance, and reverse) of the shifter of the transmission 63 and outputs this information to the ECU 61. The motor angle sensor 73 detects the angular orientation of the outboard motor 12 relative to the hull 11 about an axis substantially normal to a horizontal plane (e.g., the steering angle of the outboard motor 12) and outputs this information to the ECU 61. The engine speed sensor 74 detects the rotational speed of the engine 62 in units of revolution per unit time and outputs this information to the ECU 61.

The throttle actuator 81 is responsive to control signals from the ECU 61 and controls the amount of opening of the throttle of the engine 62. In preferred embodiments, the output of the throttle actuator 81 is based on the lever angle signal from the lever angle sensor 22 via the ECU 61. For example, as discussed above, the speed of the engine 62 is advantageously changed in response to the inclination angle (relative to the neutral position) of the remote control lever 85.

The shift actuator 82 is responsive to control signals from the ECU 61 and controls the operation of the shifter of the transmission 63. Preferably, the output of the shift actuator 82 is based on the lever angle signal from the lever angle sensor 22. For example, as discussed above the propeller 64 is advantageously caused to rotate in the forward direction when the remote control lever 85 is inclined toward the bow and is advantageously caused to rotate in the reverse direction when the remote control lever 85 is inclined toward the stem. When the remote control lever 85 is in a neutral position between the two inclined positions, the propeller 64 advantageously does not rotate.

The steering actuator 83 changes the orientation of the outboard motor 12 with respect to the hull 11 to effect directional control of the watercraft 10. Preferably, the output of the steering actuator 83 is responsive to the steering angle signal from the steering sensor 31, which is processed by the ECU 61 to produce a control signal to the actuator 83. For example, when the operator turns the steering device 30, direction of thrust of the propeller 64 is changes to change the direction of movement of the watercraft 10.

The trim control device 84 controls the tilt (trim angle) of the outboard motor 12 based on input from the trim/tilt switch 23, which is processed by the ECU 61 to produce the control signals applied to the trim control device. In particular embodiments, when the operator moves the trim/tilt switch 23 upward to increase the tilt of the outboard motor 12 towards the tilting area, the bow of the watercraft 10 raises as the watercraft 10 moves through the water. Conversely, when the operator moves the trim/tilt switch 23 downward to decrease the tilt of the outboard motor 12 toward the trimming area, the bow of the watercraft 10 lowers as the watercraft 10 moves through the water.

As set forth above, the trim control device 84 controls the position of the bow of the watercraft 10 in the water in response to the operators activation of the tilt/trim switch 23. An excessive rise of the bow results in a drop in performance in terms of rate of fuel consumption because of the increased water resistance at the hull bottom. Conversely, when the bow is too low, acceleration from a stopped condition is improved, but the stability of the watercraft 10 decreases. The watercraft 10 may also experience difficulties during maneuvering because of the increased water resistance at the bow when running at high speeds. In general both the fuel efficiency and stability are affected when the angle between the keel line and the water surface is changes by just a few degrees.

The amount of the bow that is in the water depends on the trim angle and also depends on the velocity of the watercraft, the load weight (number of passengers and crew members), and other conditions of the watercraft 10. Therefore, a low rate of fuel consumption and stability can be maintained by properly selecting the trim angle for a given set of conditions (e.g., velocity, load weight, and other relevant conditions).

FIG. 2 illustrates additional details regarding the link between the ECU 61 and the various components located in the hull 11. In particular embodiments, the link between the ECU 61 and the components in the hull 11 comprises the connecting lines 13 and 14. The connecting line 13 comprises the cable 131, the connectors 132, 133, and the cable 134. The cable 131 is connected to the start/stop switch 21, to the lever angle sensor 22, to the trim/tilt switch 23, and to the steering sensor 31. The connecting line 13 transmits the control signals produced by these components to the ECU 61, where the control signals are used by the ECU 61 to generate signals to control the outboard motor 12.

The connecting line 14 comprises the cable 141, the connectors 142, 143, and the cable 144. In particular embodiments, the cable 141 is connected to the indication device 41, to the GPS 42, to the fuel level detector 51, and to the fuel flow detector 52. The connecting line 14 transmits positioning information from the GPS 42, fuel level information from the fuel level detector 51, and fuel flow information from the fuel flow detector 52 to the ECU 61. Preferably, the ECU 61 uses this information as a basis for performing a plurality of calculations, described below, to generate additional information regarding the operation of the watercraft 10. The ECU 61 transmits the information from the GPS 42, the fuel level detector 51, the fuel flow detector 52, and the resulting calculations to the indication device 41 via the cable 14.

As can be seen from the foregoing, the connecting line 13 (cables 131, 134) is a transmission path for control signals and forms part of a control system used to control the outboard motor 12. In contrast, the connecting line 14 (cables 141, 144) is a transmission path for information and forms part of an information system that provides information to the operator regarding the state of the watercraft. Thus, the connecting line 14 is not used to transmit signals to control the outboard motor 12. The connecting line 13 is vital to the operation of the watercraft 10. In particular embodiments, the connecting line 14 is less critical to the operation of the watercraft 10. By maintaining this distinction between the connecting lines 13, 14, the cables of the two connecting lines 13, 14 are physically separated to thereby physically separate the connecting lines for the control system from the connecting lines for the information system. Physically separating the information lines from the control lines offers at least two advantages described below.

The use of separate connecting lines 13, 14 mitigates the possibility of mutual interference between the control system and the information system. Specifically, if the wiring of the information system (e.g., the connecting line 14) or equipment connected to corresponding connection nodes (e.g., I/O equipment such as the indication device 41 or the GPS 42) develop any abnormalities, any resulting abnormal condition does not affect the control system (e.g., the connecting line 13) or any of the equipment connected to corresponding connection nodes (e.g., I/O equipment such as the start/stop switch 21). For example, even if the connecting line 14 is cut or short-circuited, the operator of the watercraft 10 continues to maintain control of the outboard motor 12 via the connecting line 13.

Another advantage of physically separating the cables of the connecting line 13 from the cables of the connecting line 14 is a reduction in the possibility of wiring errors. An outboard motor is generally mounted onto the hull 11 by a builder of the hull or by the boat dealer. Generally, the manufacturer of the outboard motor supplies the outboard motor to the boat builder or boat dealer as an independent unit. Therefore, unlike the personnel who manufacture the outboard motor, the personnel mounting the outboard motor to the hull and assembling the cables 13, 14 may not possess a high level of technical skill. When a single cable contains a plurality of types wires, a possibility exists for the mounting and assembling personnel to make mistakes when interconnecting the individual wires from the outboard motor to the individual wires from the hull. By using separate cables for the information system and the control system, the possibility of a misconnection by a workman is decreased. Consistent with preferred embodiments of the present invention, the possibility of an incorrect interconnection of a one of the cables of the line 13 to one of the cables of the line 14 is decreased by conforming to the measures described below.

Preferably, a different type of connector is used for the connectors 132, 133 than is used for the connectors 142, 143. As a result, misconnection of the connector 132 to the connector 143 or misconnection of the connector 133 to the connector 142 is prevented. A wiring error caused by misconnection between the non-matching connectors is precluded since the non-matching connectors are not engageable to each other. In particular embodiments, the diameters of the connectors 132, 133 are preferably limited to not more than about 40 millimeters because of handling considerations in the hull 11. Since the wiring of the cables 131, 141 on the hull 11 side are typically laid through a pipe (inboard piping), the wiring of the cables 131, 141 becomes difficult unless connectors (e.g., the connectors 132 and 142) are used that have outside diameters that are smaller than the inside diameter of this inboard piping.

Preferably, different insulator colors are used on the wires of the cables 131, 134 than are used on the cables 141, 144. Wiring errors caused by misconnection of the cables 131, 134 or the like can be prevented if the colors of the cables 131 and 141 and the colors of the cables 134 and 144 are checked while performing the connecting work during installation of the motor on the hull. In particular embodiments, the wire insulators of the cables 131, 134 have the same color (e.g., red). Likewise, the wire insulators of the cables 141, 144 have the same color (e.g., white) that is different from the color of the cables 131, 134. In other embodiments, other markings, such as stripes, may be further used to distinguish the cables 131, 134 from the cables 141, 144 These examples are not to be construed as limiting, since other combinations of creating two sets of wire insulators that are distinct from one another are consistent with embodiments of the present invention.

Alternatively or in addition to the foregoing, wires with different thicknesses may also be used to create the two sets of cables such that the cables 131, 134 and the cables 141, 144 are distinct from one another. For example, wiring errors by misconnection of the cables 131 to the cable 144 or the like can be prevented if the thicknesses of the cable 131 and the cable 144 are checked while performing the connecting operation. In a particular example, the cable 131 and the cable 134 have a same first diameter that is different from a second diameter of the cable 141 and the cable 144.

In particular embodiments, such as the embodiment schematically illustrated in FIG. 2, the ECU 61 receives signals and information from a plurality of sensors, detectors, switches, and instruments located throughout the watercraft 10, and, in particular, located inside the outboard motor 12. During operation of the watercraft 10, information signals representing the states of the watercraft 10 and the outboard motor 12 are sent by the ECU 61 to the indication device 41 to cause information to be displayed in a manner discernible to the watercraft operator. This information comprises, for example, first data from various sensors, detectors, switches, and instruments located in the watercraft 10, and second data representing the results of calculations performed by the ECU 61 based on the first data.

Preferably, the ECU 61 transmits information to the indication section (e.g., the screen of the indication device 41) as well as to any other output devices that may advantageously be used to inform or warn the operator regarding the state of the watercraft 10 or other monitored condition. In particularly preferred embodiments, the information transmitted to and displayed on the display 41 includes, for example, a velocity S of the watercraft 10, a fuel consumption ratio E of the watercraft 10, an amount of remaining fuel ΔV in the fuel tank 53, a maximum cruising distance L based in part on the remaining fuel in the fuel tank, a maximum cruising time T based in part on the remaining fuel in the fuel tank, a return-to-port warning indication when one or more of the conditions of the watercraft is approaching or has reached an abnormal condition, an optimum trim position (angle) for the outboard motor, and other conditions and parameters of the watercraft 10 and the engine 62.

The foregoing items of information displayed in the indication section are exemplary, and it should be understood that other information and warnings consistent with embodiments of the present invention may be transmitted by the ECU 61 to a suitable indication device to inform or warn the operator regarding other states of the watercraft 10 and the outboard motor 12. Additional detail regarding the calculation of the foregoing information is provided in the following paragraphs.

Velocity S

The GPS 42 provides coordinates defining the current position of the watercraft 10. Preferably, the ECU 61 includes a velocity calculation section that calculates a value for the distance ΔL traveled by the watercraft 10 over a period of time Δt by obtaining coordinates of the watercraft 10 from the GPS 42 at two or more different times separated by Δt. The velocity calculation section estimates the velocity S of the watercraft 10 is estimated by dividing the distance ΔL by the corresponding time interval Δt in accordance with the following equation:

$$S=\Delta L/\Delta t. \tag{1}$$

In the foregoing expression, the velocity S advantageously is expressed in units of kilometers per hour (km/h) or knots (nautical miles per hour).

Fuel Consumption Ratio E

The fuel flow detector 52 produces a signal indicates the rate of fuel consumption F in units of volume or mass per unit time (e.g., liters/hour). Preferably, the ECU 61 includes a consumption ratio calculation section that calculates a fuel consumption ratio E in units of volume or mass per unit distance (e.g., liters/kilometer or liters/nautical mile) based on the rate of fuel consumption F and the calculated velocity S of the watercraft 10 in accordance with the following equation:

$$E=F/S. \tag{2}$$

The rate of fuel consumption F usually depends on the velocity S. Therefore, the fuel consumption ratio E also usually depends on the velocity S. The fuel consumption ratio E generally decreases with increasing velocity S.

Amount of Remaining Fuel ΔV in the Fuel Tank

Preferably, the ECU 61 receives a signal from the fuel level detector 51 that indicates the amount of remaining fuel ΔV in the fuel tank 53 in units of volume or mass (e.g., liters). In other embodiments, the amount of remaining fuel ΔV is calculated by the ECU 61 based on the signal produced by the fuel flow detector 52 based on the following equation:

$$\Delta V=V0-V1, \tag{3}$$

where V0 is the initial amount of fuel contained by the fuel tank 53 and V1 is the amount of fuel consumed by the engine 62. Preferably, the ECU 61 includes residual amount of fuel calculation section that estimates the amount of fuel consumed, V1, based on integration of the signal from fuel flow detector 52 over time.

Maximum Cruising Distance L

Preferably, the ECU 61 includes maximum cruising distance calculation section that produces an estimate of the maximum cruising distance L, which is the maximum distance the watercraft 10 can travel from the current location of the watercraft 10 based on the amount of remaining fuel ΔV and the current fuel consumption ratio E. The maximum cruising distance L is determined by the in accordance with the following equation:

$$L=\Delta V\times E. \tag{4}$$

The maximum cruising distance L calculated using the foregoing relationship depends on the velocity S because the fuel consumption ratio E changes with the watercraft velocity S. That is, the maximum cruising distance L obtainable by the watercraft 10 depends on the current watercraft velocity S and may change if the watercraft velocity S is changed.

Maximum Cruising Time T

Preferably, the ECU 61 includes maximum cruising time calculation section that produces an estimate of the maximum cruising time T, which is a length of time that the watercraft 10 can continue to travel at the current velocity S. The maximum cruising time T is calculated by the ECU 61 using the maximum cruising distance L and the watercraft velocity S by using the following equation:

$$T=L/S. \tag{5}$$

Return-to-Port Warning

In a preferred embodiment, a return-to-port warning device determines when conditions are such that the watercraft operator should set a course back to the home port and issues a return-to-port warning to one or more output devices such as the indication device 41. Preferably, the ECU 61 includes return-to-port warning section that generates the return-to-port warning when the ECU 61 determines that certain conditions of the watercraft 10 or the motor 12 are true. The return-to-port warning advises the operator that conditions are such that the operators should apply control inputs to the watercraft 10 to initiate a course back to the home port (or other designated location) programmed into the ECU 61. The home port may be a port where the watercraft initially started or the home port may be a destination port.

The return-to-port warnings issued by the ECU 61 include at least two different warnings that are issued under differing conditions. A return-to-port distance calculation section and a first return-to-port judgement section are used to produce return-to-port distance warning when the maximum cruising distance L approaches the distance of the watercraft 10 from the home port.

The return-to-port distance calculation section and a second return-to-port judgement section are used to produce return-to-port time warning when the expected arrival time at the home port, based on a velocity of the watercraft 10 and the distance of the watercraft 10 from the home port, is approximately equal to an expected return-to-port time previously designated by the operator and stored in an expected return-to-port time storage section (e.g., stored in one of the storage devices associated with the ECU 61). For example, the watercraft operator may have informed friends, relatives or other potentially concerned persons that the operator would return from a boating excursion by a certain time. Alternatively, the watercraft operator may not be allowed to enter the home port after a designated closing time.

The two return-to-port warnings are generated automatically by the ECU 61, thereby freeing the operator and others aboard the watercraft to concentrate on other matters (e.g., fishing, recreational activities or other activities). Specifically, the ECU 61 reminds the operator of the need to return to the home port when the operator has failed to monitor the amount of fuel remaining or to monitor the time required for returning to the home port.

In particular embodiments, in addition to visually displaying the return-to-port warning on the indication device 41, additional devices are advantageously used to warn the operator. For example, a speaker or siren may be used to produce an audible sound, or a light emitting device may be used to produce a readily observable visual effect.

The first return-to-port judgement section generates a return-to-port distance warning to notify the operator that if the watercraft travels further away from the home port, sufficient fuel may not be available to enable the watercraft to return to the home port under existing conditions. In particularly preferred embodiments, the return-to-port distance warning is issued when the following condition is met:

$$L \leqq L0 \times k1, \tag{6}$$

where L is the maximum cruising distance calculated above using the equation (4), where L0 is the distance from the current watercraft location to the home port (e.g., the return-to-port distance in nautical miles), and where k1 is a safety factor having a preferred value between approximately 1.2 and 1.3. In particular, the return-to-port distance L0 is the straight line distance calculated based on the differences between the coordinates of the home port and the current coordinates of the watercraft 10, as indicated by the GPS 42. The safety factor k1 accounts for possible errors in the calculation of the maximum cruising distance L.

The second return-to-port judgement section generates a return-to-port time warning to notify the operator that if the watercraft travels further away from the home port, a danger exists of arriving later than an expected return-to-port time designated by the operator. For example, if the home port closed at a certain time, the watercraft would not be able to enter if the watercraft arrives after that certain time. The decision by the ECU 61 to issue a return-to-port time warning is determined by comparing an expected return-to-port time t2 to an estimated arrival time t1. The return-to-port time warning is issued when the following condition is met:

$$t2-t0<(t1-t0)\times k2=(L0/S)\times k2, \tag{7}$$

where t0 is the current time and k2 is a safety factor having a preferred value between approximately 1.2 and 1.3. In certain embodiments, the quantity (t1−t0) is estimated as the return-to-port distance L0 divided by the current velocity S of the watercraft 10. In other embodiments, the quantity (t1−t0) is estimated as the return-to-port distance L0 divided by a different velocity such as some percentage of an estimated maximum velocity attainable by the watercraft 10. The safety factor k2 accounts for possible errors in the calculation of the velocity S, errors in the calculation of the return-to-port distance L0, or errors in the calculations of both values.

In particular embodiments, as illustrated, for example, by the flowchart in FIG. 3, a procedure 100 is advantageously used by the ECU 61 to determine when to issue one or more return-to-port warnings. The procedure 100 is illustrative and should not be construed as limiting because similar procedures consistent with embodiments of the current invention may also be advantageously used to determine when to issue a return-to-port warning based either on the criteria described above or based on other criteria such as a specific event, a condition of the watercraft 10, or a particular weather condition.

The procedure 100 comprises a step 101 in which the location (e.g., the coordinates) of the home port is set. The coordinates of the home port are entered into the ECU 61 and are stored in the storage device, in the auxiliary storage device, or in a similar that is part of the ECU 61. In particular embodiments, the coordinates of the home port are entered into the ECU 61 by the operator. In alternative embodiments, the operator enters appropriate information to identify the home port, such as, for example, a name of the home port. Preferably, when the name of the home port or other information identifying the home port is entered, the coordinates of the home port are advantageously determined from a correlation table stored in the auxiliary storage device of the ECU 61.

The procedure 100 further comprises a step 102 in which the expected or required return-to-port time t2 is entered when the user has a specified time for arriving at the home port.

The procedure 100 further comprises a step 103 in which a maximum cruising distance L is calculated. Preferably, the maximum cruising distance L is calculated based on the amount of remaining fuel ΔV in the fuel tank 53 and the fuel consumption ratio E calculated using the equation (4). Preferably, the amount of remaining fuel ΔV is calculated by time-integration of the fuel flow rate based on an output of the fuel flow detector 52. In other embodiments, the amount of remaining fuel ΔV in the fuel 53 is determined based on an output of the fuel level detector 51. In certain embodiments, the fuel consumption ratio E is calculated based on the rate of fuel consumption F and the velocity S of the watercraft 10.

The procedure 100 further comprises a step 104 in which a return-to-port distance LO is calculated based on the difference between the coordinates of the home port and the current coordinates of the watercraft 10, as indicated by the GPS 42.

The procedure 100 further comprises a decision step 105 in which the procedure determines whether the maximum cruising distance L is sufficiently larger than the return-to-port distance L0 based on the relationship in the condition (6).

If the relationship in the condition (6) is not true when evaluated in the decision step 105, the procedure advances to a step 106. If the relationship in the condition (6) is true, the procedure advances to a decision step 107.

In the step 106, the ECU 61 issues a return-to-port distance warning to indicate to the operator that the return-to-port distance is approaching too close to the maximum cruising distance. The return-to-port warning is indicated by the indication device 41, and, in alternative embodiments, the return-to-part warning is also indicated by other warning devices. The procedure 100 then returns to the step 103 to repeat the foregoing steps of the procedure to again evaluate the conditions and determine whether a return-to-port warning should be issued.

In the decision step 107, the procedure 100 determines whether an expected return-to-port time t2 has been inputted and stored in the ECU 61. If an expected return-to-port time t2 has not been inputted and stored, the procedure returns to the step 103 to again evaluate the conditions and determine whether a return-to-port warning should be issued.

If an expected return-to-port time t2 has been inputted and stored, the procedure advances from the decision step 107 to a step 108. In the step 108, an estimated arrival time t1 to the home port is calculated. The estimated arrival time is derived by using the return-to-port distance L0 divided by the current velocity S of the watercraft 10 to determine the return-to-port travel time and adding the return-to-port travel time to the current time t0.

After calculating the estimated arrival time t1 in the step 108, the procedure 100 advances to a step 109 and determines whether the estimated arrival time t1 is sufficiently earlier than the expected return-to-port time t2. It should be understood that calculation of the estimated arrival time t1 in the step 108 and the comparison of the estimated arrival time in the step 109 advantageously determine whether the relationship in the condition (7) is satisfied.

If the procedure 100 determines in the step 109 that the estimated arrival time t1 is not sufficiently earlier than the expected return-to-port time t2, the procedure advances to a step 110 to issue a return-to-port time warning indicating that the estimated arrival time t1 is approaching too close to the expected return-to-port time t2. The return-to-port warning is indicated by the indication device 41, and, in alternative embodiments, the return-to-part warning is also indicated by other warning devices. The procedure 100 then returns to the step 103 of the procedure to again evaluate the conditions and determine whether a return-to-port warning should be issued.

If the procedure 100 determines in the step 109 that the estimated arrival time t1 is sufficiently earlier than the expected return-to-port time t2, no warning is issued, and the procedure 100 returns to the step 103 of the procedure to again evaluate the conditions and determine whether a return-to-port warning should be issued.

Optimum Trim Position (Trim Angle)

As described above, the trim angle affects the fuel efficiency of the watercraft 10. Preferably, an optimum trim angle is indicated by the indication device 41 or other such device in response to the velocity of the watercraft 10 and any other relevant parameters to provide beneficial operational information to the operator. The information enables the operator to set the trim angle of the outboard motor 12 to correspond to the optimum trim angle by operating the trim/tilt switch 23.

In particular embodiments, a conversion table is located in the auxiliary storage device of the ECU 61. The conversion table stores relationships between the optimum trim angle and the velocity S, the load weight, and other relevant parameters. In such embodiments, the value of an optimum trim angle is determined by accessing the conversion table based on the values of the relevant parameters. The values of some parameters used to access the conversion table are measured or calculated by the ECU 61. Other parameters, such as, for example, the load weight for the watercraft 10 cannot be automatically measured in most watercraft; however, such parameters may advantageously be entered manually by the operator. The optimum trim angles for selected conditions can be indicated, for example, using tables or graphs that represent a relationship between the load weight and the corresponding optimum trim angle.

Once all relevant parameters have been entered, the ECU 61 displays the optimum trim angle using the parameters to access the value of the optimum trim angle in the conversion table. The development of the values of the optimum trim angle responsive to the changing velocity or the like can be found by a boat builder or by a driver running the watercraft 10 under varying conditions of the trim angle, velocity, and load weight, while measuring the fuel consumption ratio E, stability and the like.

Other Conditions and Parameters of the Watercraft and the Engine

In certain embodiments, the ECU 61 includes one or more judgement sections that monitor other conditions of the watercraft 10 and the engine 62 of the outboard motor 12 and displays the conditions on the indication device 41. For example the engine speed measured by the engine speed sensor 74, may be displayed on the indication device 41 along with a warning if the engine speed reaches a limit that may cause damage (e.g., the engine is operating in an abnormal speed region). Similarly, the measured cooling water temperature is advantageously displayed along with any indication that the temperature is outside an acceptable range (e.g., the engine temperature is in an abnormal temperature region).

In alternative embodiments, the ECU 61 monitors a plurality of outboard motors 12 on a single watercraft 10, and information regarding each outboard motor 12 is displayed on the single indication device 41. If a problem develops with one or more of the outboard motors 12, the occurrence of such events are reported by the ECU 61 along with suggested points of inspection, suggested methods of fixing the problem, and other information that is relevant to the operator.

In alternative embodiments, points of inspection and methods of fixing a problem are retrieved from information in a correlation table stored in the auxiliary storage device of the ECU 61, and the retrieved information is displayed on the display 41. In particular, the ECU 61 advantageously uses the correlation table to correlate abnormal parameters to points of inspection and to methods of fixing a problem. For example, a rise in the cooling water temperature resulting from blockage of the intake port for cooling water could be correlated with a suggestion to check for sea weed or other debris at the intake port. In other alternative embodiments, the ECU 61 determines when parameters such as engine speed and engine temperature are outside of a normal range and reports such events to the operator using, for example, the indication device 41 or some other suitable indication device such as an audible alarm.

In certain embodiments, at least some of the information received by the ECU 62 or derived using the ECU 62 is transmitted to the indication device 41 in the form of graphical information or another format readily interpreted by the operator. In other embodiments additional devices are advantageously used to relay information or issue warnings. For example, a speaker or siren may be used to produce an audible sound, or a light emitting device may be used to produce a readily observable visual effect.

The foregoing embodiments are exemplary and should not be construed as limiting, since other embodiments consistent with the present invention may be used by those skilled in the art for particular sets of requirements. For example, a return-to-port warning (return-to-port distance warning and return-to-port time warning) can be set to have a plurality of stages such that the warning changes form or magnitude as the amount of fuel remaining in the fuel tank 53 continues to decrease. One advantageous method to achieve the stages uses a plurality of numerical values for the safety factors in the condition (6) and the condition (7).

The control signals applied to the input of the ECU 61 are not limited to those produced by the start/stop switch 21, the lever angle sensor 22, the trim/tilt switch 23 or the steering sensor 31, but may advantageously include any other signals that may represent conditions critical for the control of the outboard motor 12. For example, if automatic operation of the watercraft 10 is possible based on the positional information from the GPS 42, a signal from the GPS 42 may be indirectly utilized to control the outboard motor 12. Thus, a signal indirectly utilized for the control of the outboard motor 12 is included as a control signal.

As described above, the preferred embodiments provide a watercraft, an outboard motor and an outboard motor control device that are capable of continuing the operation of the outboard motor even if a portion of an inboard local area network develops an abnormality. The preferred embodiments also provide a system that includes an indication device capable of displaying warnings to an operator when an abnormality has occurred. In addition to abnormalities in the operation of the watercraft or the outboard motor, the system also displays warnings based on the operating conditions of the watercraft that may preclude the watercraft from returning to a home port or other destination unless the operator initiates navigational operations to direct the watercraft towards the home port or other destination.

Although described above in connection with particular embodiments of the present invention, it should be understood the descriptions of the embodiments are illustrative of the invention and are not intended to be limiting. Various modifications and applications may occur to those skilled in the art without departing from the true spirit and scope of the invention as defined in the appended claims.

What is claimed is:

1. A system for an outboard motor that propels a watercraft, the system comprising:

a control input section that receives at least one command to control an outboard motor;

a control section that controls the outboard motor in response to the command received by the control input section;

a conditional information section that outputs at least one conditional information signal indicative of a condition of a watercraft;

a local area network (LAN) including a first cable connected to the control input section and a second cable connected to the conditional information section, the second cable separate from the first cable.

2. The system according to claim 1, wherein the command received by the control input section includes at least one of a throttling operation, a shifting operation, a steering operation, a starting operation or a stopping operation of the outboard motor.

3. The system according to claim 1, further comprising:

an indication device connected to the second cable;

a display signal transmitted by the second cable wherein the display signal includes at least part of the information contained in the conditional information signal.

4. The system according to claim 1, wherein the first and second cables differ from each other by at least one of a size, a shape or a color.

5. The system according to claim 1, wherein respective first and second connector are connected to the first and second cables, the first and second connectors having respective first and second shapes, the first shape differing from the second shape.

6. An operating device for an outboard motor that propels a watercraft, the operating device comprising:

an indication section that indicates a condition of a watercraft;

a control input section that receives at least one command to control the watercraft and that outputs at least one control signal corresponding to the command;

a first and a second cable, each cable transmitting a different signal, the first cable transmitting the control signal outputted from the control input section and the second cable transmitting a condition signal indicative of the condition of the watercraft to the indication section, the second cable separate from the first cable.

7. The operating device according to claim 6, further comprising a velocity calculation section that calculates a velocity of the watercraft based on a change in location of the watercraft with time, wherein the indication section indicates the velocity calculated by the velocity calculation section.

8. The operating device according to claim 6, further comprising a fuel consumption ratio calculation section that calculates a fuel consumption ratio of the watercraft based on the velocity of the watercraft and based on a change in fuel consumption by the outboard motor with time, wherein the indication section indicates the fuel consumption ratio calculated by the fuel consumption ratio calculation section.

9. The operating device according to claim 6, further comprising a residual amount of fuel calculation section that calculates a residual amount of fuel of the watercraft based on the fuel consumption of the outboard motor, wherein the indication section indicates the residual amount of fuel calculated by the residual amount-of-fuel calculation section.

10. The operating device according to claim 6, further comprising a maximum cruising distance calculation section that calculates a maximum cruising distance of the watercraft based on a fuel consumption ratio and a residual amount of fuel of the watercraft, wherein the indication section indicates the maximum cruising distance calculated by the maximum cruising distance calculation section.

11. The operating device according to claim 6, further comprising a maximum cruising time calculation section that calculates a maximum cruising time of the watercraft based on the velocity and the maximum cruising distance of the watercraft, wherein the indication section indicates the maximum cruising time calculated by the maximum cruising time calculation section.

12. The operating device according to claim 6, further comprising a table that represents a relation between the velocity of the watercraft and the optimum trim angle of the outboard motor, wherein the indication section indicates an optimum trim angle based on the table.

13. The operating device according to claim 6, wherein the indication section indicates a condition of the outboard motor based on detection results by a detection section that detects a condition of the outboard motor.

14. The operating device according to claim 13, wherein the watercraft comprises a plurality of outboard motors, and the indication section also indicates conditions of the plurality of outboard motors.

15. The operating device according to claim 13, further comprising a judgment section that determines whether the condition of the outboard motor is within a normal range, wherein when the judgment section determines that the condition of the outboard motor is out of the normal range, the indication section indicates information that the outboard motor is operating in an abnormal region of the operating condition of the outboard motor.

16. A watercraft comprising:

an indication section that indicates a condition of a watercraft;

a control input section that receives at least one command to control an outboard motor and that outputs a control signal corresponding to the command;

a first cable that transmits the control signal outputted from the control input section;

a second cable that transmits a condition signal indicative of the condition of the watercraft to the indication section, the second cable separate from the first cable;

a third cable corresponding to the first cable, the third cable transmitting the control signal;

a fourth cable corresponding to the second cable, the fourth cable transmitting the condition signal, the fourth cable separate from the third cable;

a control section that controls the outboard motor based on the control signal transmitted by the third cable; and a conditional information section coupled to the control section via at least one of the second cable and the fourth cable.

17. A return-to-port warning device comprising:

a maximum cruising distance calculation section that calculates a maximum cruising distance based on a residual amount of fuel and a fuel consumption ratio;

a return-to-port distance calculation section that calculates a return-to-port distance from the current location to a home port; and a return-to-port judgment section that determines whether a return-to-port warning is issued to indicate that a watercraft should return to the home port in order to avoid fuel exhaustion, the determination based on a comparison between the maximum cruising distance calculated by the maximum cruising distance calculation section and the return-to-port distance calculated by the return-to-port distance calculation section.

18. The return-to-port warning device according to claim 17, further comprising:

an expected return-to-port time storage section that stores an expected return-to-port time to the home port;

an arrival time calculation section that calculates an arrival time at the home port based on the return-to-port distance calculated by the return-to-port distance calculation section; and a second return-to-port judgment section that determines whether a second return-to-port warning is issued to indicate that the watercraft should return to the home port in order to avoid arriving later than the expected return-to-port time, the determination based on a comparison between the arrival time calculated by the arrival time calculation section and the expected return-to-port time.

19. A return-to-port warning method comprising:

calculating a maximum cruising distance based on a residual amount of fuel and a fuel consumption ratio;

calculating a return-to-port distance from the current location to a home port; and determining whether to issue a return-to-port warning to indicate that a watercraft should return to the home port based on a comparison between the calculated maximum cruising distance and the calculated return-to-port distance.

20. The return-to-port warning method according to claim 19, further comprising:

calculating an arrival time at the home port based on the calculated return-to-port distance; and determining whether to issue a second return-to-port warning to indicate that the watercraft should return to the home port based on a comparison between the calculated arrival time and the expected return-to-port time.

21. The system according to claim 1, wherein each cable transmits a different signal.

22. The operating device according to claim 6, wherein the first cable and the second cable are part of a local area network (LAN).

* * * * *